US007063217B2

(12) United States Patent
Burke

(10) Patent No.: US 7,063,217 B2
(45) Date of Patent: Jun. 20, 2006

(54) MODULAR DISPLAY RACK HAVING HORIZONTALLY SEPARABLE FRONT BARRIER

(75) Inventor: Robert P. Burke, Laguna Niguel, CA (US)

(73) Assignee: Burke Display Systems, Inc., Dana Point, CA (US)

( * ) Notice: Subject to any disclaimer, the term of this patent is extended or adjusted under 35 U.S.C. 154(b) by 167 days.

(21) Appl. No.: 10/623,759

(22) Filed: Jul. 21, 2003

(65) Prior Publication Data

US 2004/0118795 A1 Jun. 24, 2004

Related U.S. Application Data

(60) Provisional application No. 60/453,690, filed on Dec. 23, 2002.

(51) Int. Cl.
*A47F 1/00* (2006.01)

(52) U.S. Cl. ..... 211/59.3; 211/59.2; 211/184; 211/119.003; 312/71

(58) Field of Classification Search ..... 211/59.2, 211/59.3, 119.003, 184; 312/61, 71
See application file for complete search history.

(56) References Cited

U.S. PATENT DOCUMENTS

| | | | |
|---|---|---|---|
| 2,110,299 | A | 3/1938 | Hinkle |
| 2,652,154 | A | 9/1953 | Stevens |
| 2,934,212 | A | 4/1960 | Jacobson |
| 3,161,295 | A | 12/1964 | Chesley |
| 3,308,961 | A | 3/1967 | Chesley |
| 3,830,169 | A | 8/1974 | Madey |
| D256,301 | S | 8/1980 | Cutts |
| 4,300,693 | A | 11/1981 | Spamer |
| 4,303,162 | A | 12/1981 | Suttles |
| 4,504,100 | A | 3/1985 | Chaumard |
| 4,724,968 | A | 2/1988 | Wombacher |
| 4,730,741 | A | 3/1988 | Jackle, III et al. |
| 4,762,236 | A | 8/1988 | Jackle, III et al. |
| 4,821,894 | A | 4/1989 | Dechirot |
| D300,994 | S | 5/1989 | Wolff |
| 4,830,201 | A | 5/1989 | Breslow |
| 4,836,390 | A | 6/1989 | Polvere |
| 4,898,282 | A | 2/1990 | Hawkinson et al. |
| 4,899,893 | A | 2/1990 | Robertson |
| 4,901,869 | A | 2/1990 | Hawkinson et al. |
| 4,907,707 | A | 3/1990 | Crum |
| 5,012,936 | A | 5/1991 | Crum |
| 5,027,957 | A | 7/1991 | Skalski |
| D318,769 | S | 8/1991 | Marchiony et al. |
| 5,069,349 | A | 12/1991 | Wear et al. |
| 5,082,125 | A | 1/1992 | Ninni |
| 5,085,154 | A | 2/1992 | Merl |
| 5,088,607 | A | 2/1992 | Risafi et al. |
| 5,111,942 | A | 5/1992 | Bernardin |

(Continued)

FOREIGN PATENT DOCUMENTS

| | | |
|---|---|---|
| FI | 43097 | 1/1970 |

(Continued)

*Primary Examiner*—Jennifer E. Novosad
(74) *Attorney, Agent, or Firm*—Knobbe, Martens, Olson & Bear, LLP

(57) ABSTRACT

A display rack for rounded articles generally includes a product track with a pusher block slidably mounted thereon. The pusher block is biased toward a front portion of the display rack, and the side walls of the display rack are configured to support a circular or elliptical product. Additionally, the display rack can be provided with front and/or rear removable panel carriers configured to removably receive front and rear panels.

6 Claims, 7 Drawing Sheets

U.S. PATENT DOCUMENTS 5,123,546 A 6/1992 Crum
5,190,186 A 3/1993 Yablans et al.
5,203,463 A 4/1993 Gold
5,240,126 A 8/1993 Foster et al.
5,265,738 A 11/1993 Yablans et al.
5,341,945 A 8/1994 Gibson
5,353,939 A 10/1994 Beeler et al.
5,366,033 A 11/1994 Koivisto
5,366,099 A 11/1994 Schmid
5,390,802 A 2/1995 Pappagallo et al.
5,413,229 A 5/1995 Zuberbuhler et al.
5,450,968 A 9/1995 Bustos
5,450,969 A 9/1995 Johnson et al.
5,469,976 A 11/1995 Burchell
5,542,552 A 8/1996 Yablans et al.
5,562,217 A 10/1996 Salveson et al.
5,605,237 A 2/1997 Richardson et al.
5,634,564 A 6/1997 Spamer et al.
5,638,963 A 6/1997 Finnelly et al.
5,665,304 A 9/1997 Heinen et al.
5,673,801 A 10/1997 Markson
5,685,664 A 11/1997 Parham et al.
5,746,328 A 5/1998 Beeler et al.
5,806,690 A 9/1998 Johnson et al.
5,839,588 A 11/1998 Hawkinson
5,855,281 A 1/1999 Rabas
5,855,283 A 1/1999 Johnson
5,873,489 A 2/1999 Ide et al.
5,878,895 A 3/1999 Springs
5,881,910 A 3/1999 Rein
5,992,652 A 11/1999 Springs
5,992,653 A 11/1999 Anderson et al.
6,041,720 A 3/2000 Hardy
6,047,647 A * 4/2000 Laraia, Jr. ..... 108/61
6,082,557 A 7/2000 Leahy
6,105,791 A 8/2000 Chalson et al.
6,142,317 A 11/2000 Merl
6,155,438 A 12/2000 Close
6,227,385 B1 5/2001 Nickerson
6,234,328 B1 5/2001 Mason
D445,615 S 7/2001 Burke
6,299,004 B1 * 10/2001 Thalenfeld et al. ..... 211/184
6,382,431 B1 5/2002 Burke
6,484,891 B1 11/2002 Burke
2001/0035383 A1 * 11/2001 Burke ..... 211/59.3
2002/0088762 A1 7/2002 Burke
2003/0010732 A1 1/2003 Burke
2004/0140278 A1 * 7/2004 Mueller et al. ..... 211/59.3
2004/0140279 A1 * 7/2004 Mueller et al. ..... 211/59.3

FOREIGN PATENT DOCUMENTS

FR 2 385 365 12/1978

* cited by examiner

MODULAR DISPLAY RACK HAVING HORIZONTALLY SEPARABLE FRONT BARRIER

CROSS-REFERENCE TO RELATED APPLICATIONS

This application claims the benefit of U.S. Provisional Patent Application Ser. No. 60/453,690 filed on Dec. 23, 2002, the entire contents of which is incorporated herein by reference and made part of the present disclosure.

BACKGROUND OF THE INVENTION

1. Field of the Invention

The present invention generally relates to the field of adjustable shelf management systems and more specifically relates to an adjustable shelf management system with a horizontally separable front barrier and mounting arrangement.

2. Description of the Related Art

Shelving is used extensively for stocking and storing products or merchandise in a variety of stores. Most stores have immovable shelving, which is arranged back-to-back between aisleways. The nature of the fixed shelves makes it difficult to add and remove products. Moreover, such shelves make difficult the rotation of the shelved products, which involves moving the older stock to the front of the shelf and positioning new stock behind the older stock.

Numerous forward feeding devices have been devised to automatically move products forward as they are removed. By moving products forward, the shelves consistently appear to be fully stocked. There are believed to be psychological benefits to such an appearance.

Forward feeding devices can generally be grouped into three categories. The first category includes inclined tracks relying on gravity to feed the product forward. Gravity feeding works well for some products, but is unpredictable in that some materials slide easier than others due to differences in weights and frictional interfaces between the products and the track. The second category generally uses gravity-driven conveyor belts, which can tend to be cumbersome, expensive and complicated due to the need to properly tension and track the conveyor belts.

The third category uses springs to feed the product forward. The springs result in a simple, inexpensive design which will smoothly move products forward. There have been a number of variations on this type of design. Many of these spring-biased devices have the disadvantage that they can only be used for a very limited size of product. In addition, even if designed for variations in size, many of the designs are complicated and difficult to alter.

Most of the previous systems are particularly suited to products having flat or rectangular shapes. Notwithstanding the particular advantages of these systems, there remains a need for a shelving system capable of supporting non-rectangular products.

SUMMARY OF THE INVENTION

According to one embodiment, a shelf management system for storing and displaying products on a shelf is provided. The system comprises a product track extending generally transverse to the length of the shelf and adapted to be positioned in multiple locations along the length of the shelf. The system further includes a pusher block slidably attached to the product track and urged toward an end of the product track that is close to the front of the shelf by a biasing member. The system also includes a carrier configured to support a barrier at the front of the product track, wherein the carrier is removable from the system.

According to another embodiment, a product track is provided comprising a base and a pair of raised rails that extend upward from said base, a pusher block slidably attached to said pair of raised rails, a biasing member connected to the pusher block, and a carrier having a longitudinal slot adapted to extend transversely to the product track. The carrier also comprises a support portion adapted to underlie and support at least a portion of the product track. A removable front barrier is adapted to be received in a slot of the carrier.

According to yet another embodiment, a horizontally separable front barrier for use with a product display rack is provided. The barrier comprises a longitudinal base portion with a pair of walls extending upward from the base. The walls form a longitudinal channel adapted to receive a barrier which comprises a lower portion adapted to be received in the channel of the base portion. An upper portion is adapted to provide a physical barrier against which products may abut.

One aspect of the present invention involves a shelf management system for storing and displaying products on a shelf. The shelf comprises a front and a support surface that extends over a length of the shelf. The shelf management system comprises a product track that extends generally transverse to the length of the shelf and that is adapted to be positioned in multiple locations along the length of the shelf. A pusher block is slidably attached to the product track. A biasing member urges the pusher block toward an end of the product track that is disposed closest to the front of the shelf. A carrier plate is adapted to be positioned between at least a portion of the product track and the support surface of the shelf. The carrier plate comprises a pair of upstanding members that together define a slot. A panel comprises a lower portion and an upper portion with the upper portion comprising a flange that extends over at least a portion of the product track and the lower portion being adapted to be frictionally engaged within the slot.

Another aspect of the present invention involves a modular display rack comprising a product track comprising a base and a pair of raised rails that extend upward from the base. A pusher block is slidably attached to the pair of raised rails. A biasing member abuts a portion of the pusher block. A carrier has a longitudinal slot adapted to extend transversely to the product track. The carrier also comprises a support portion adapted to underlie and support at least a portion of the product track. A removable panel has a lower portion adapted to be received in a slot of the carrier.

A further aspect of the present invention involves a horizontally separable front barrier for use with a product display rack. The barrier comprises a carrier comprising a base portion and a spaced pair of walls extending upward from the base with the walls forming a channel. The barrier also comprises a panel comprising a lower portion sized and configured to be received in the channel of the carrier and an upper portion that extends upward from the lower portion and that comprises a flange that extends generally normal to the spaced pair of walls of the carrier.

An additional aspect of the present invention involves a method of installing a shelf management system. The method comprises: securing a panel carrier to a self; positioning at least one product supporting and feeding assembly over a portion of the panel carrier; and securing a front panel over a portion of the at least one assembly and within a portion of the panel carrier.

For purposes of summarizing the invention and the advantages achieved over the prior art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The disclosed embodiment(s) are intended to be within the scope of the present invention herein disclosed and will become readily apparent to those skilled in the art from the following detailed description of the preferred embodiment(s) having reference to the attached figures. The invention should not be limited to any particular preferred embodiment(s) disclosed.

BRIEF DESCRIPTION OF DRAWINGS

Having thus summarized the general nature of the invention, certain preferred embodiments and modifications thereof will become apparent to those skilled in the art from the following detailed description having reference to the figures that follow.

DETAILED DESCRIPTION OF THE PREFERRED EMBODIMENT

Figure 1:
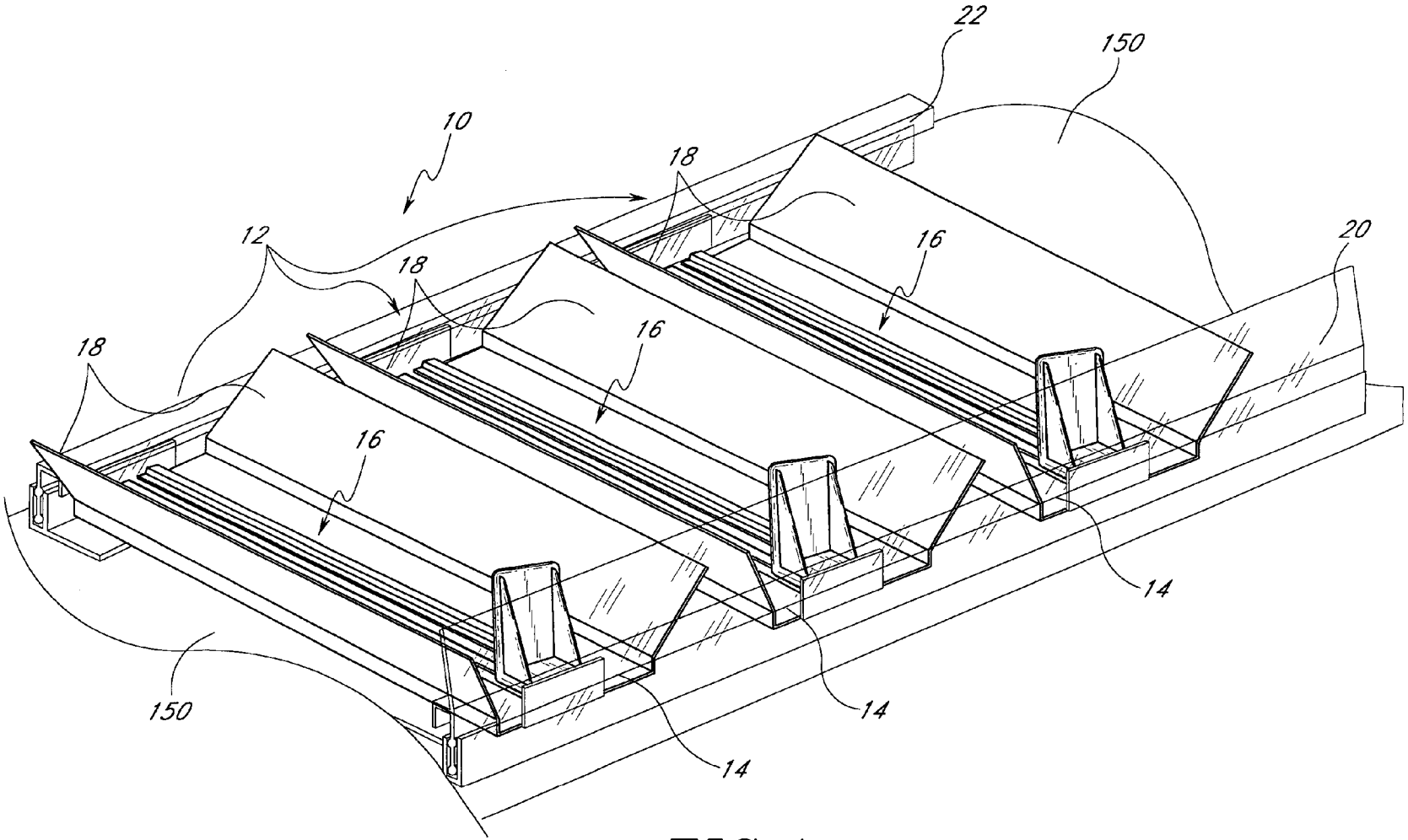
FIG. 1 is a perspective view of a modular display system having a plurality of product supporting and feeding assemblies.

With reference initially to FIG. 1, an adjustable shelf management system, generally designated by reference numeral 10, is illustrated. The adjustable shelf management system 10 is configured and arranged to accept packages of various sizes, weights and configurations, and particularly packages with a rounded profile. For instance, the present adjustable shelf management system may be used with prepackaged paper plates, chilled whipped cream tubs and the like. Additionally, in another embodiment, the present adjustable shelf management system 10 may have particular utility with pharmaceutical products, such as jars or bottles containing drugs and vitamins. The present adjustable shelf management system 10 may find utility in a variety of environments, including grocery stores, warehouses, hospitals, drug stores, office supply rooms, auto parts stores and clothing stores, for instance, but without limitation.

The present adjustable shelf management system 10 generally includes at least one product supporting and feeding assembly 12. Each assembly 12 preferably comprises a base 14, a product track 16, and a pair of sidewalls 18. The size and number of the feeding assemblies 12 may be determined generally by the size of the shelf or the area of the shelf to be used and/or by the product to be displayed. The system 10 also includes a front panel 20 and a back panel 22, both of which may be attachable to a shelf 150 in any suitable manner, including the manner described below.

The back panel 22 of the system 10 may be configured in any suitable manner. The system 10 may include a back panel 22 which simply restrains the product supporting and feeding assemblies 12 from substantial vertical movement relative to the balance of the system. In one arrangement, the back panel 22 is omitted.

The assemblies 12 can be mounted to the shelf 150 in any suitable manner. For instance, the feeding assemblies can have a magnetized plate, strip or portion attached to the bottom which allows for attachment of the assembly 12 to a metallic shelf 150. In some arrangements, the front panel 20 and/or back panel 22 can be permanently attached to the feeding assemblies 12. In such arrangements, the front 20 and rear 20 panels preferably are sized to be the same length as an individual feeding assembly 12 so the spacing between the assemblies 12 can be adjusted. In the illustrated arrangement, the assemblies 12 are mounted to the shelf 150 with the front and real panels 20, 22.

With reference now to FIGS. 3–6*b*, the front and rear panels 20, 22 will be discussed in detail beginning with the front panel 20. The front panel 20 preferably is generally planar and extends generally vertically relative to the generally horizontal shelf 150. The front panel 20 in the illustrated arrangement also comprises a rearwardly extending upper flange 32. The upper flange 32 desirably extends rearward and comprises a downwardly extending lip. The flange 32, together with a portion of the front panel 20, advantageously defines a race 33. The race 33 is preferably sized and configured to allow relatively free movement of product tracks as described in U.S. Pat. No. 6,382,431 (the '431 patent), which is incorporated herein by reference in its entirety.

The illustrated front panel 20 also comprises a lower portion 34 (see FIG. 4), which includes two protuberances 35. The protuberances 35 can have any suitable size, shape, number and configuration. In one preferred embodiment, the protuberances are vertically about 0.500" from one another. The protuberances 35 can be continuous along the length of the front panel 20 or can be intermittently disposed over the length of the front panel 20. For instance, the protuberances 35 can be cylindrical, as in the illustrated arrangement, spherical, square bar, diamond bar or any other structure. These protuberances 35 allow the lower portion 34 to be stably inserted into a channel or slot 54 defined within a panel carrier 50. The slot 54 may be any appropriate width, for example, a slot 54 may be about 0.160" wide to receive a panel with protuberances of approximately the same diameter (i.e., about 0.160").

An upper portion of the illustrated front panel 20 serves as a product retaining wall 36, which desirably extends upward and preferably angles slightly rearward from a location above the upper flange 32. The product retaining wall 36 serves as a forward-most stopping surface for the adjustable shelf management system 10 and is desirably angled rearward to help pinch and hold product within the adjustable shelf management system 10 while the product is being urged forward in the manner described in greater detail below.

The rear panel 22 advantageously is configured such that it will extend over and secure multiple product tracks 16 in place and can also attach to the back of the shelf 150. The rear panel 22 may be configured to simply hold the product tracks 16 stably and may generally comprise an upper flange 40 and a back surface 41. As described with the front panel 20, the upper flange 40 and a portion of the back surface 42 defines a race 43. The race 43 captures the track 16 or an end clip 60 associated with the track 16 to secure the track 16 against free vertical movement while allowing side to side movement.

The illustrated rear panel 22 further comprises a lower portion 44, which includes two protuberances 45 that can be suitably configured as discussed above. The protuberances 45 allow the lower portion 44 to be inserted into the slot 54 of an associated panel carrier 50.

Figure 3:
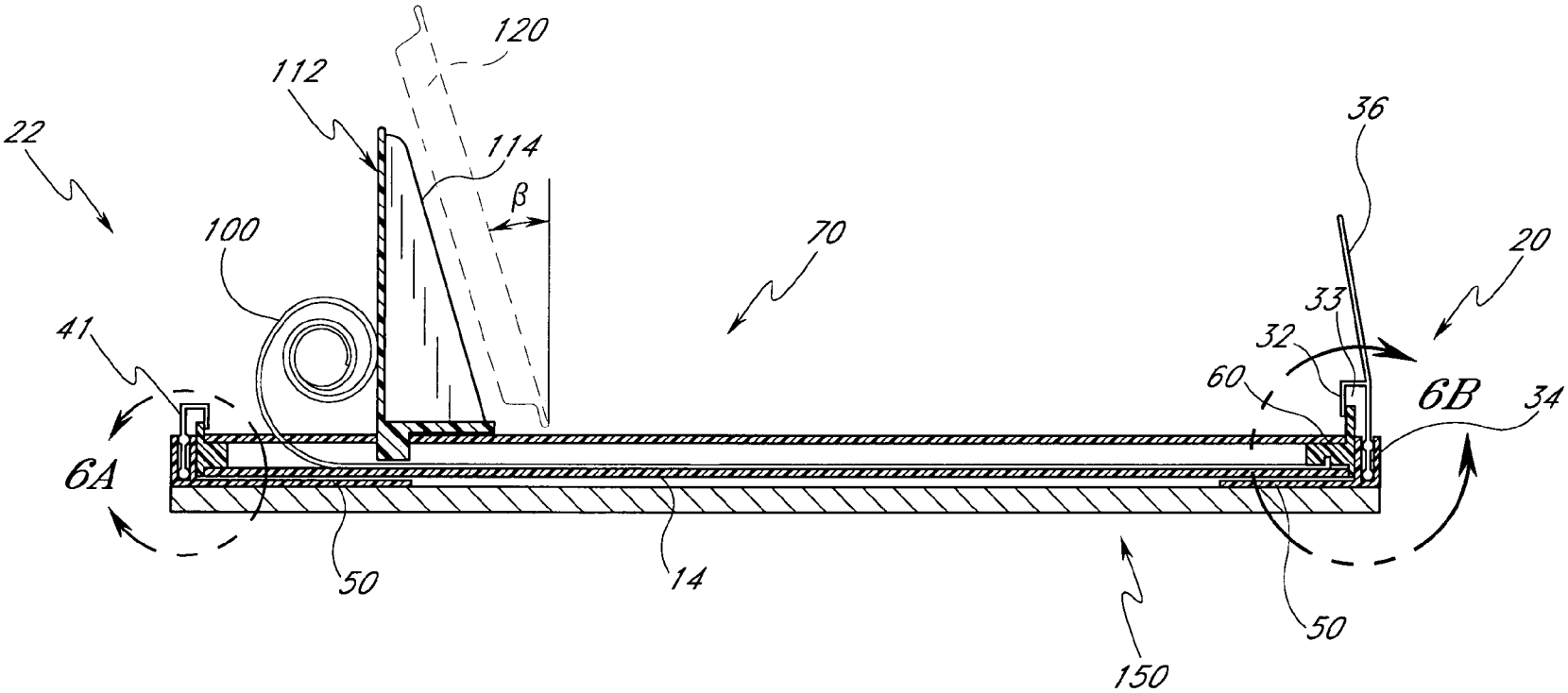
FIG. 3 is a section view of a portion of the system of FIG. 1 taken through line 3—3.
Figure 4:
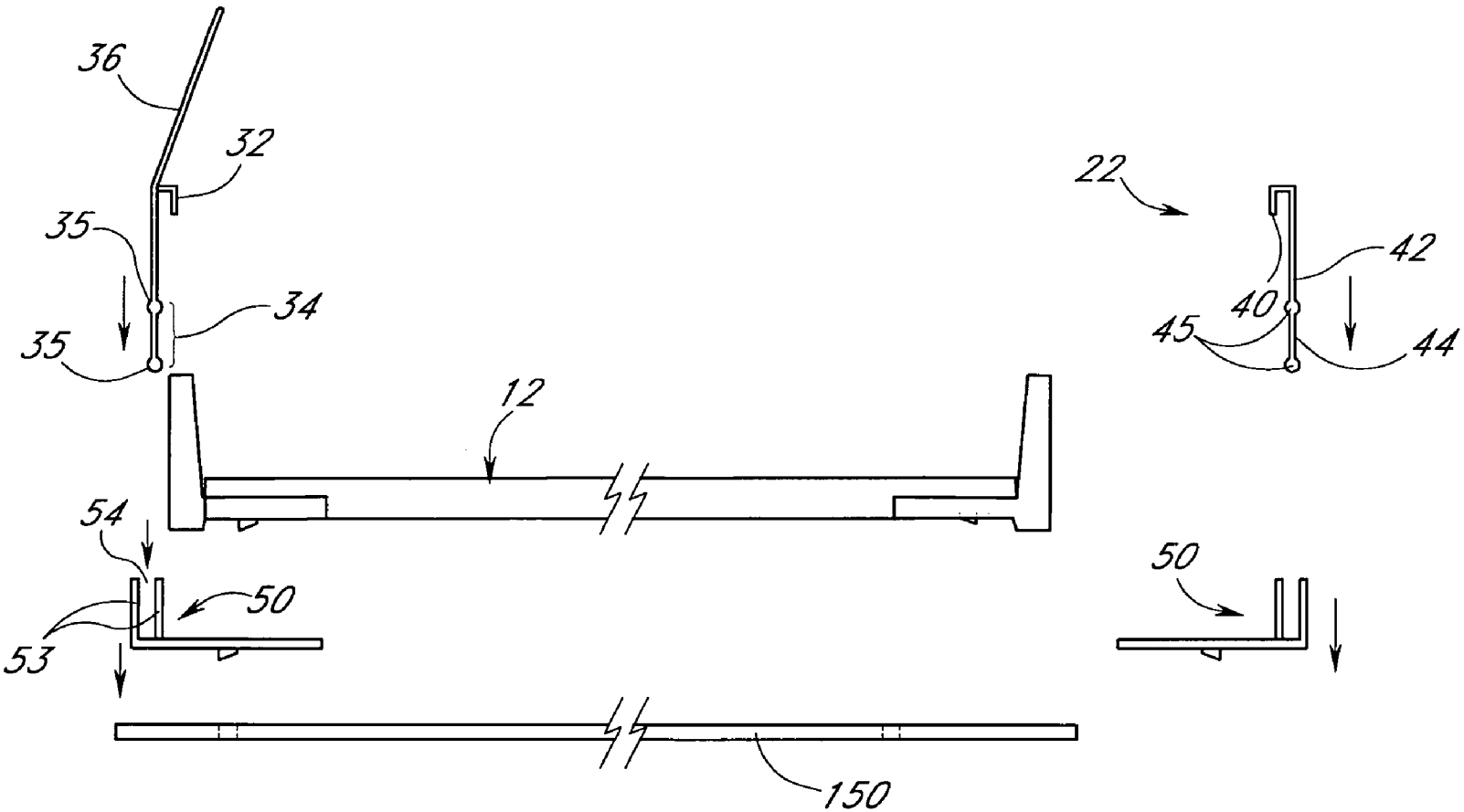
FIG. 4 is an exploded side elevation view illustrating an assembly arrangement for a modular display system.
Figure 5:
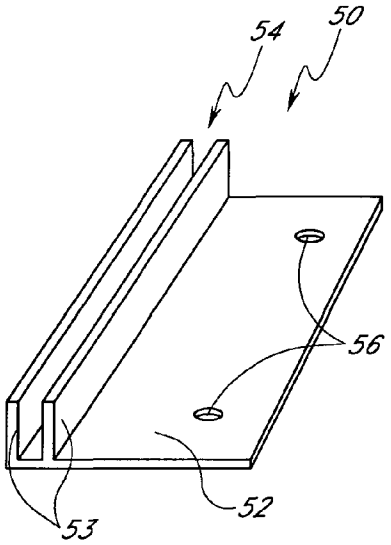
FIG. 5 is a perspective view of a portion of a panel carrier for use in a modular display system.

With reference to FIGS. 3–5, the panel carrier 50 may be provided for use with shelves which do not include integral slots 54 for receiving the front and/or rear panels 20, 22. The illustrated panel carrier 50 generally comprises a base 52, which extends under at least a portion of the display rack base 14.

The panel carrier 50 further includes a pair of walls 53 extending upward from the base 52. The walls 53 preferably are parallel to each other and define the slot 54. As such, in one preferred arrangement, the walls 53 extend substantially the length of the system 10. In some arrangements, the walls 53 can be segmented. In one arrangement, the walls 53 are solid along their length. The carrier wall height desirably is sized to correspond to the length of the lower portion 34, 42 of the associated front or rear panel 20, 22. The slot 54 defined between the carrier walls 53 may be sized to allow the respective protuberances 35, 45, 20, 22 to be snugly received therein.

Figure 8:
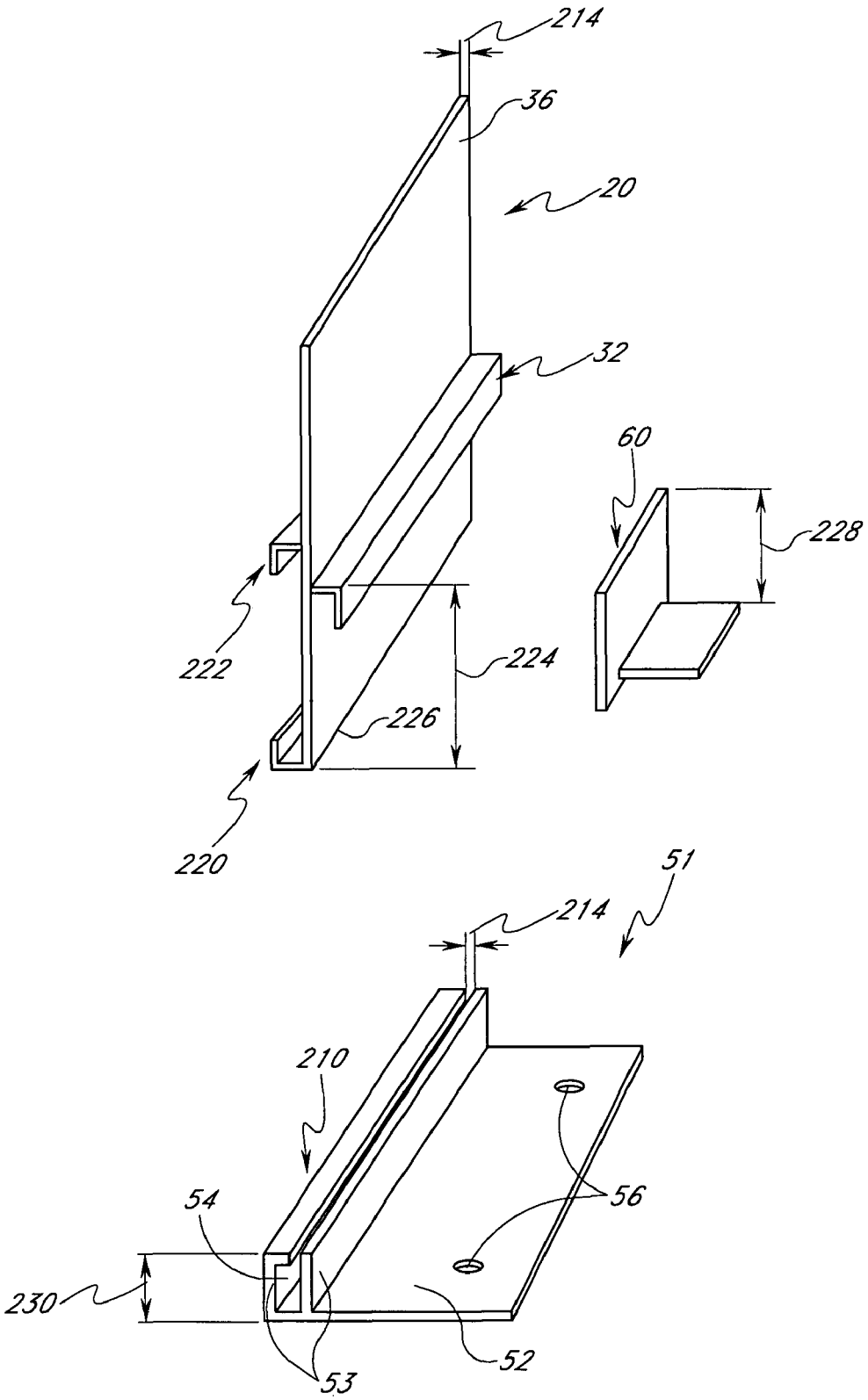
FIG. 8 is a perspective view of an alternative embodiment of a panel carrier and front barrier.

In an alternative embodiment of a panel carrier 51, as illustrated in FIG. 8, an upper portion of one or both walls 53 of the panel carrier channel 54 can be provided with a flange 210 for engaging and retaining a front barrier 20 received in the channel 54. The flange 210 illustrated in FIG. 8 is generally L-shaped, however an upper flange on a panel carrier wall 53 could alternatively be U-shaped, J-shaped, semi-circular, or any other shape as desired. The flange 210 can be sized such that a space 212 between the end of the flange 210 and the opposite wall 53 of the carrier channel 54 is approximately equal to a thickness 214 of a front panel 20, although the space 212 can be larger or smaller than the thickness 214 as desired.

If desired, the front panel 20 can be provided with a lower flange 220 for retaining the panel 20 within the panel carrier channel 54. The illustrated panel 20 and lower flange 220 generally form a J-shaped structure. Alternatively, the front panel 20 can include a lower flange 220 with a substantially L-shape, U-shape, triangular shape, semi-circular shape, or any other shape as desired. The lower flange 220 of the front panel 20 is generally adapted to retain the front panel within the channel or slot 54 of the panel carrier 51. The lower flange 220 can be interchangeable with the protuberances 35, 45 described above for retaining the panel 20 within the slot 54.

The front panel 20 can also include an upper front J-shaped flange 222 such that a placard or label can be retained between the upper front flange 222 and the lower front flange 220 or the top of the flange 210. In the embodiment shown, a placard held between the upper 222 and lower 220 front flanges can extend at least partially below the upper flange 210 of the panel carrier 51 in an assembled position. If desired, the front panel 20 or the panel carrier can include a lower portion extending below a lower flange 220. Such a lower portion can include additional features such as a flange or protuberance for retaining the front panel 20 within the slot 54 of the panel carrier 51 while leaving a label or placard to be positioned above the top of the panel carrier walls 53.

In the embodiment illustrated in FIG. 8, the front panel includes a rear flange 32 for engaging a clip 60 mounted to, or formed integrally with, a front end or other portion of a product track. A height 224 between the bottom edge 226 of the front panel 20 and the rear flange 32 is generally equal to or greater than a height 228 of a clip 60. Thus, when the front panel 20 and the panel carrier 51 are assembled, one or more clips 60 can be slidably retained in a race formed between the rear flange 32 of the front panel, and the base 52 of the panel carrier 51.

In order to release the clip(s) 60 from the assembly, the panel carrier 20 can be moved upwards within the channel 54 until the bottom of the rear flange 32 is vertically above the clip 60. The panel 20 can be moved upward until the lower flange 220 of the front panel 20 engages the upper flange 210 of the panel carrier 51, thereby substantially inhibiting the front panel 20 from being vertically removed from the panel carrier 51. Thus, a height 230 of the walls 53 is preferably large enough to allow the front panel 20 to be moved sufficiently to release a clip 60 from the race between the rear flange 32 and the carrier base 52. In addition, the upper flange 210 preferably is sized and configured to substantially inhibit complete removal of the front panel 20 unless such a removal is desired. In other words, inadvertent removal of the front panel 20 is substantially inhibited. In this manner, the panel and/or the carrier comprise(s) a structure that substantially prevents the panel from being vertically removed from the channel. In the illustrated arrangement, the panel and the carrier comprise structures that are adapted to substantially prevent the panel from being vertically removed from the carrier. For instance, interengaging structures can be provided. In one particularly preferred arrangement, the panel and/or the carrier comprises a flange that substantially prevents the panel from being vertically removed from the carrier.

The upper portion 36 of the front barrier 20 can be folded forward away from the base 52 to a position in which the front panel 20 is angled or substantially perpendicular to the walls 53 of the panel carrier 51. From this position, the product tracks can be easily added, removed, relocated, and/or reloaded without interference from the front barrier 20. Advantageously, the illustrated front barrier 20 and the panel carrier 57 are configured such that the front barrier 20 can maintain this relationship without substantive human intervention.

If it is desired to completely remove the front barrier 20 from the panel carrier 51, the barrier 20 can be further rotated away from the base 52 until the barrier 20 "pops" out of the panel carrier 51. The panel 20 and carrier 51 of FIG. 8 can then be reassembled by sliding the front panel 20 longitudinally into the panel carrier channel 54 from one end. Alternatively, the flanges 220 and/or 210 can be configured to allow the front barrier 20 to "snap" vertically downward into engagement with the slot 54. This can be accomplished, for example, by providing a substantially L-shaped lower flange on the front panel 20. Such an L-shaped flange can then be engaged with the space 212 of the slot 54, and the panel 20 can be rotated toward the product track and into a vertical orientation. Alternatively, a lower portion of the panel could include barbs or other structures for allowing the front panel to snap into a slot 54 with a flange 210 extending from at least one wall 53.

The panel carriers 50 may be provided with holes 56, protruding structures or fastener-receiving features in order to allow the carriers to be secured to a shelf. As such, the panel carriers 50 can be secured to the shelf 150 by screws, bolts, adhesives, magnets, hook-and-loop systems, clips (such as those shown and described herein) or any other temporary or permanent securement method or device.

With reference to FIG. 4, the illustrated arrangement advantageously provides easy assembly, reconfigurations and reassembly. As illustrated, the panel carriers 50 can be attached to the shelf 150 in any suitable manner. Once the panel carriers 50 have been secured or placed in position, one or more appropriately sized assemblies 12 can be positioned over the base 52 of each carrier 50. With the assemblies in position, the front panel 20 and the rear panel 22, each comprising the associated extensions 34, 44 and flanges 32, 42, can be used to secure the assemblies 12 on the shelf 150. Advantageously, the illustrated arrangement allows a single front panel to capture multiple assemblies in position, thereby simplifying installations and reducing assembly time.

Figure 2:
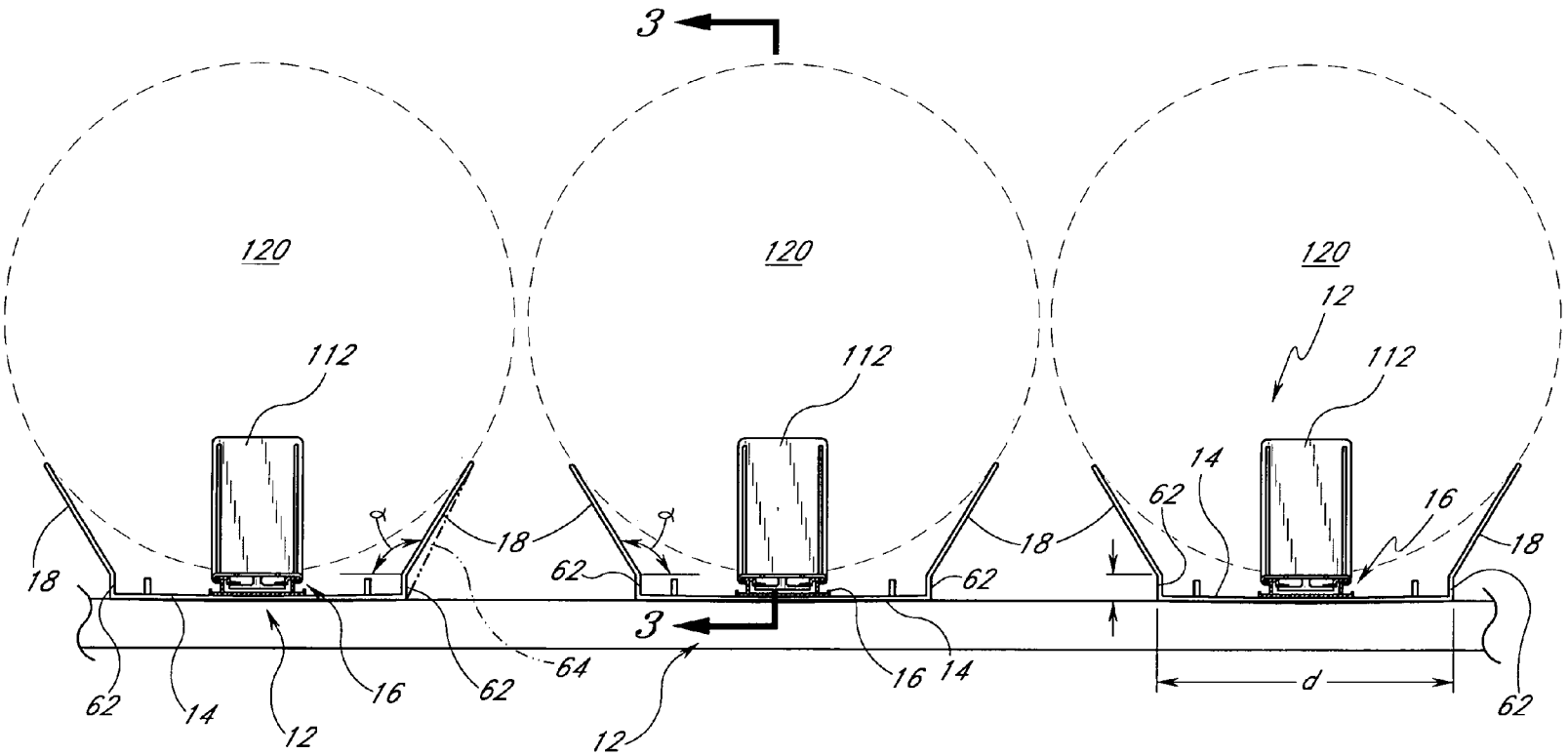
FIG. 2 is a front elevation view of the system of FIG. 1.

With reference now to FIGS. 1 and 2, the side walls 18 of an individual product supporting and feeding assembly 12 may comprise portions which are angled substantially outwards away from the product track 16 in order to support substantially rounded products such as paper plates. The side walls 18 of the product track may comprise vertical portions 62 which may extend upwards by a height of between about 0.1" and about 0.4", and in some embodiments about 0.3".

According to the illustrated embodiment, the side walls 18 are angled away from the center of the product track by an obtuse angle $\alpha$ relative to a plane that extends along the product supporting surface of the product track. The angle $\alpha$ of the side walls may be varied based on a size or shape of a product to be displayed. For example, in the case of a circular product such as that shown in FIG. 2, the side walls 18 may comprise an obtuse angle $\alpha$ relative to the horizontal of between about 100° and about 140°, preferably between about 115° and about 125° and in some embodiments the angle $\alpha$ is about 120°. Alternatively, the side walls may comprise larger or smaller obtuse angles depending upon the needs of the user. Providing the product tracks 16 with angled side walls 18 allows the display rack to support circular or elliptical articles while occupying a relatively small footprint on the shelf. In some arrangements, gussets 64 may support the side walls 18 (one shown in phantom). The gussets 64 can be intermittently dispersed in a spaced relationship along the length of the assembly 12 to increase the load bearing capability of the track. If molded, the gussets 64 can be integrally formed with the side walls 18. For instance, a hollow member can be formed by the gusset 64, the vertical portion of the side wall and the angled portion of the side wall, which hollow member acts as a continuous gusset along the length of the side wall.

The distance d between the vertical portions 52 of the side walls 18 (or the lowermost edges) may vary according to the size of the rounded products to be displayed. In many embodiments for use with standard paper plates, the distance between the vertical portions 52 of the side walls 18 is between about 4.75" and about 5.25, preferably between about 4.9" and about 5.2", and in some embodiments, the distance d is about 5.09". The side walls 18 may be integrally formed with the base portion 14, or they may be configured to be removable. In some embodiments, the product track and side walls may be configured to be adjustable between a plurality of horizontal positions to accommodate products of varying sizes.

The shelf management system also comprises a track 16 to guide the pusher block. The track extends longitudinally between first and second ends, and laterally between first and second sides. The track 16 illustrated herein may be substantially similar to that described in detail in the '431 patent, or any other appropriate track may be used.

In some instances, the product tracks 16 and side walls 18 are integrally formed (i.e., molded or extruded to form a single piece, for example) and in other instances, the product tracks are separate from the side walls. In most instances, the side walls 18 will include a portion or a segment of product track to allow the walls 18 to also function as a support surface. Moreover, the product tracks 16 and the side walls 18*a* may use ridges to decrease the contact surface area between the packages and the product supporting and feeding assembly 12 such that friction may be reduced between the products and the assembly 12.

The product track 16 is generally configured to allow a pusher block 112 to be slidably movable thereon. The track illustrated in the figures is substantially similar to the product track shown and described in the '431 patent, however other product track configurations may be desirable in some applications and may be used with a display system as described herein. The track 16 may be configured to receive clips 60 or 61 at the front and/or rear end of the track 16.

Figure 6B:
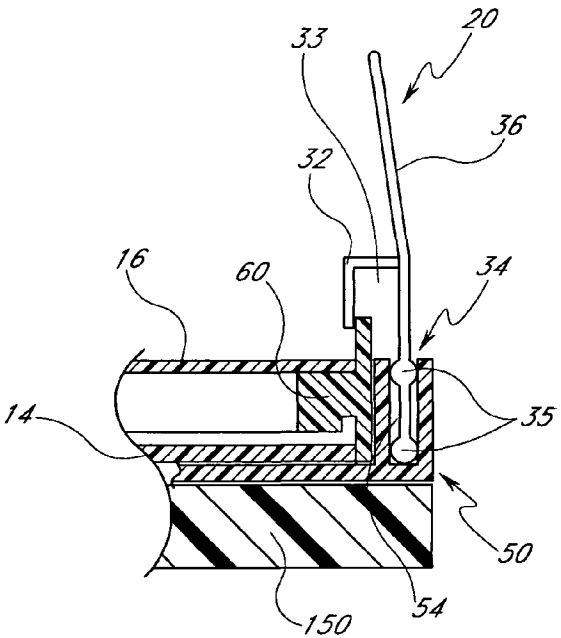
FIG. 6B is an enlarged view of a front portion of the display system of FIG. 3.
Figure 6A:
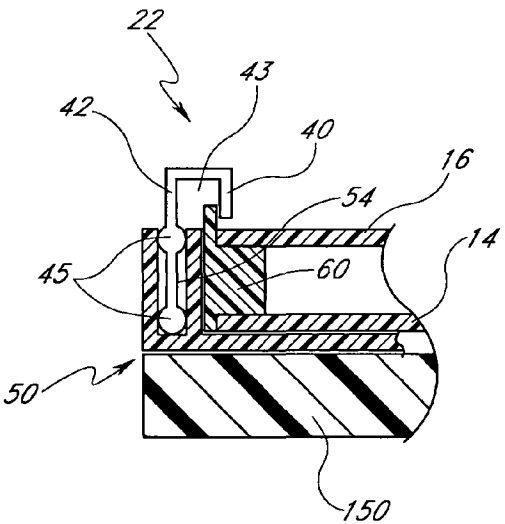
FIG. 6A is an enlarged view of a rear portion of the display system of FIG. 3.
Figure 7:
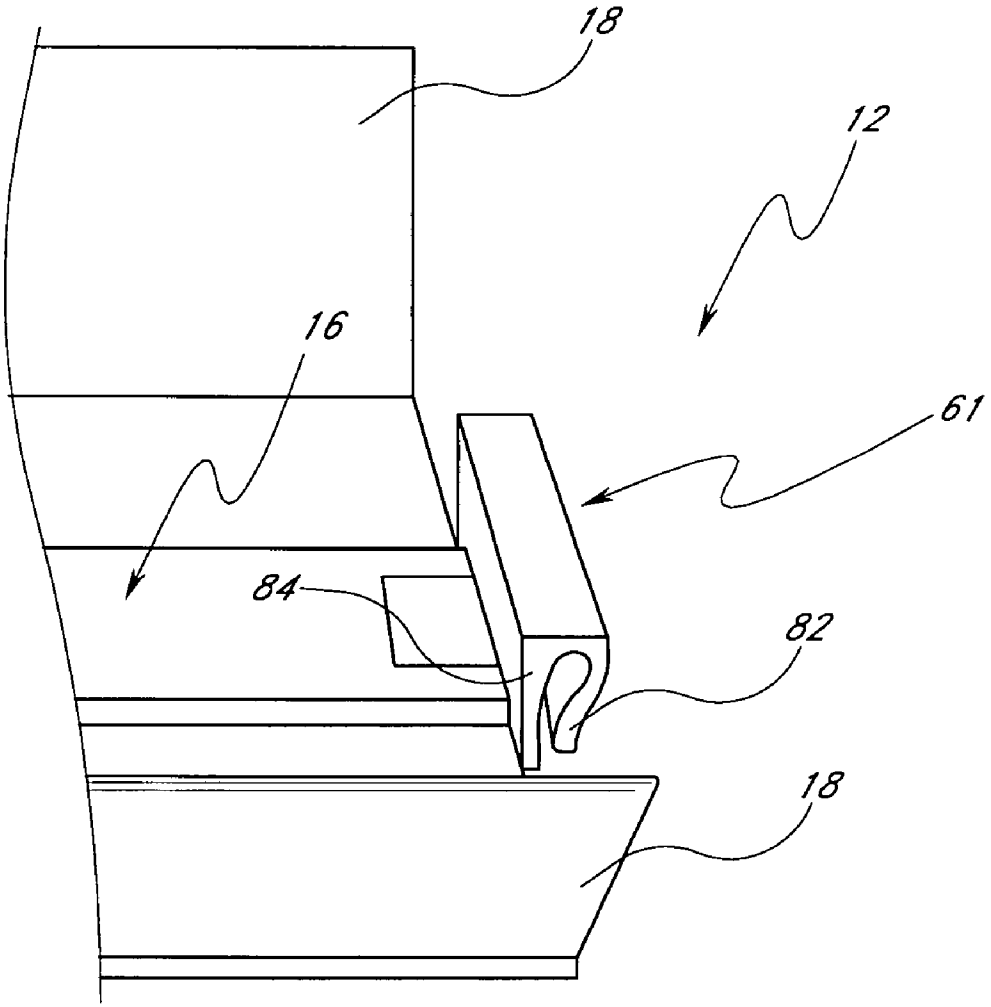
FIG. 7 is a perspective view of an alternative embodiment of a clip for a display system.

Various types of clips may be used, for example to attach the track 16 to portions of the shelf, or to a race defined by the front panel 20 and a portion of a shelf or panel carrier. For example, one embodiment of a clip 60 shown in FIGS. 1 and 6 is configured to be received in the race 33 such that the track may slide horizontally along the shelf, but will be restrained from vertical displacement by the upper flange 32. An alternative clip 61 illustrated in FIG. 7 may be used with a shelf or front or rear panel having a vertical rail which may be received in the clip 61. The clip 61 generally includes a leg 82 biased toward the body 84 of the clip 61 such that a rail may be received and frictionally retained in the space between the leg 82 and the body 84. The clip 61 thus provides resistance to lateral and vertical movement of the product track, but will allow the track to be moved if sufficient force is applied. In some embodiments, a shelf may be provided with a rail suitable for being received by the clip, alternatively a suitable rail may be provided as a portion of the front panel 36, the rear panel 41, or either the front or rear panel carriers 50.

With continued reference to FIGS. 1 and 3, the pusher block 112 is typically biased toward the front panel 20 by a roll spring 100 or other appropriate biasing mechanism. For example, coil springs, elastic straps, ropes, and a variety of other springs and biasing members may be used. The pusher block 112 and roll spring 100 may be arranged as shown in FIG. 3. In the illustrated arrangement, the roll spring 100 is attached to the base 14 at a point substantially near the front of the product track 16. The roll spring 100 may be permanently or removably attached to the base 14 by rivets, threaded fasteners, adhesives, or any other suitable method. The free end of the roll spring engages a rearward-facing portion of the pusher block 112, thereby urging the pusher block toward the front 20 of the product track 14 as the spring re-coils. If desired, the spring-engaging surface of the pusher block 112 may be provided with webs, notches, or other features to retain the roll spring 100 in a desired lateral position on the pusher block.

As shown in FIG. 3, the pusher block 112 may include an angled front surface 114 such that a product 120 may be supported at an angle β relative to the vertical. This allows a customer to more easily view a front surface of a product 120 supported by the present system. The particular angle β of the pusher block front surface may be varied as desired. For example, a larger angle β may be desirable for a display system to be placed on a shelf which sits substantially below a customer's eye-level, while a smaller angle may be desirable for a display system to be placed on a shelf which sits substantially above a customer's eye-level. In one exemplary embodiment, the angle β is about 15°. Alternatively, the pusher block 112 may be attached to the track 16 in a reverse orientation to that presented above such that the product is directly contacting the vertical side of the pusher block 112.

Generally, the adjustable shelf management system 10 may be made of any suitable material. For example, materials from the styrene family or self-lubricating FDA approved plastics, such as acrylonitrile-butadiene-styrene (ABS) may be used. In other embodiments, the components may be manufactured from stainless steel, UHMW, or other metallic or synthetic materials as desired. The materials are typically chosen to allow for easy cleaning and reduce adsorption of liquids. In applications not involving food products, the materials may be chosen from any material considered desirable to the user. Where materials are not judiciously chosen to result in a self-lubricating nature to the product, materials such as brass or bronze or any other bearing type surface material may be utilized with steels and the like. Additionally, a silicon spray may be used to coat the surfaces to increase the lubrication between the moving components. In some embodiments, the front panel 20 may be opaque, transparent or translucent. In the illustrated embodiment, the front panel 20 comprises a clear plastic material to allow the prospective purchaser a clear line of vision to the product being carried by the adjustable shelf management system 10.

In use, the shelf management system is sized and configured using various product tracks 16 and side walls 18 to closely approximate the size of the packaging of the products being carried. Generally speaking, a front panel carrier 50 and possibly a rear panel carrier 50 can be mounted to the shelf. With any desired carriers 50 in position, the assemblies 12 can be positioned as desired. In the illustrated arrangement, the assemblies 12 comprise both the product tracks 16 and the side walls 18. In other arrangements, the tracks 16 and the side walls 18 can be positioned as desired. In any event, the assemblies, tracks and side walls desirably are positioned to overlie a portion of the carrier(s) 50. Once positioned, the front panel 20 is snapped into place in the groove of the panel carrier 50 and, if desired, the rear panel 22 is snapped into place in the groove of the corresponding panel carrier 50. The assemblies (and/or tracks and side walls) are then secured from removal from the shelf.

With the assembly complete, product may be loaded into the shelf management system 10 by moving the pusher block 112 toward the rear panel 22 while stocking the product forward of the pusher block 112. As products are removed from between the pusher block 112 and the front panel 20, the pusher block will be urged forward under the bias of the roll spring 100 until the supply of product is depleted. When restocking, the pusher block 112 may be simply slid rearward and the new product positioned rearward of the old product to ensure a continuous cycling of product. Of course, in the case of non-perishables, products may be re-stocked front-to-back or back-to-front as desired.

Although certain embodiments and examples have been described herein, it will be understood by those skilled in the art that many aspects of the methods and devices shown and described in the present disclosure may be differently combined and/or modified to form still further embodiments. Additionally, it will be recognized that the methods described herein may be practiced using any device suitable for performing the recited steps. Such alternative embodiments and/or uses of the methods and devices described above and obvious modifications and equivalents thereof are intended to be within the scope of the present disclosure. Thus, it is intended that the scope of the present invention should not be limited by the particular embodiments described above, but should be determined only by a fair reading of the claims that follow.

What is claimed is:

1. A shelf management system for storing and displaying products on a shelf, the shelf comprising a front and a support surface that extends over a length of the shelf, said shelf management system comprising:

a product track extending generally transverse to the length of the shelf and being adapted to be positioned in multiple locations along the length of the shelf;

a pusher block slidably attached to said product track;

a biasing member urging said pusher block toward an end of said product track that is disposed closest to the front of the shelf;

a carrier plate adapted to be positioned between at least a portion of said product track and said support surface of the shelf, said carrier plate comprising a pair of upstanding members that together define a slot, a panel comprising a lower portion and an upper portion, said upper portion comprising a flange that extends over at least a portion of said product track and said lower portion being adapted to be engaged within said slot.

2. The system of claim 1, wherein at least one of the upstanding members of said carrier plate includes a flange for retaining the lower portion of the panel within said slot.

3. The system of claim 1, wherein the lower portion of the panel further comprises a flange for retaining said lower portion of said panel in said slot.

4. The system of claim 1 further comprising a second product track, said panel sized to span a distance between said product track and said second product track.

5. The system of claim 1, wherein said lower portion of said panel comprises at least one protuberance that engages within said slot of said carrier.

6. The system of claim 1, wherein said carrier is made of extruded plastic.

* * * * *